US008160470B2

(12) United States Patent
Shouno et al.

(10) Patent No.: US 8,160,470 B2
(45) Date of Patent: Apr. 17, 2012

(54) CLEANING ROLLER FOR CLEANING CHARGING ROLLER AND IMAGE FORMING APPARATUS

(75) Inventors: Junpei Shouno, Kawasaki (JP); Yohei Nakade, Okazaki (JP); Ichiro Demizu, Toyonaka (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 573 days.

(21) Appl. No.: 12/344,674

(22) Filed: Dec. 29, 2008

(65) Prior Publication Data

US 2009/0169237 A1 Jul. 2, 2009

(30) Foreign Application Priority Data

Dec. 28, 2007 (JP) ..... 2007-340269
Nov. 13, 2008 (JP) ..... 2008-291126

(51) Int. Cl.
*G03G 15/02* (2006.01)

(52) U.S. Cl. ..... 399/100; 399/168; 399/176

(58) Field of Classification Search ..... 399/100, 399/168, 176
See application file for complete search history.

(56) References Cited

U.S. PATENT DOCUMENTS

| | | | | |
|---|---|---|---|---|
| 6,381,432 | B1 * | 4/2002 | Hattori | 399/176 |
| 6,701,105 | B2 * | 3/2004 | Funabashi | 399/100 |
| 2007/0092289 | A1 * | 4/2007 | Nagamori et al. | 399/100 |
| 2007/0104504 | A1 * | 5/2007 | Terai et al. | 399/100 |
| 2007/0292158 | A1 * | 12/2007 | Matsumoto et al. | 399/100 |
| 2008/0019729 | A1 * | 1/2008 | Hoshio et al. | 399/100 |
| 2008/0025753 | A1 * | 1/2008 | Yamamoto et al. | 399/100 |
| 2008/0181655 | A1 * | 7/2008 | Sakagawa et al. | 399/100 |
| 2009/0162092 | A1 * | 6/2009 | Hoshio | 399/100 |

FOREIGN PATENT DOCUMENTS

| | | | |
|---|---|---|---|
| JP | 08-062949 | | 3/1996 |
| JP | 9-127768 | A | 5/1997 |
| JP | 2000-320536 | | 11/2000 |
| JP | 2004-361916 | A | 12/2004 |
| JP | 2005-227411 | A | 8/2005 |
| JP | 2006-330613 | A | 12/2006 |
| JP | 2007-079111 | | 3/2007 |
| JP | 2007-171288 | | 7/2007 |
| JP | 2007-248921 | | 9/2007 |

OTHER PUBLICATIONS

An English Translation of Office Action (Notice of Rejection) dated Jan. 26, 2010, issued in the corresponding Japanese Patent Application No. 2008-291126.
Office Action dated Jan. 26, 2010, issued in the corresponding Japanese Patent Application No. 2008-291126.

* cited by examiner

*Primary Examiner* — David Gray
*Assistant Examiner* — G. M. Hyder
(74) *Attorney, Agent, or Firm* — Buchanan Ingersoll & Rooney PC

(57) ABSTRACT

A cleaning roller for cleaning a charging roller in an image forming apparatus is disposed in contact with an outer peripheral surface of a charging roller to remove foreign matters attached to the outer peripheral surface of the charging roller. The cleaning roller has a metal core and a polyurethane foam layer covering an outer peripheral surface of this metal core. The polyurethane foam layer includes a number of cells. The number of cells per inch is 40 or more and 80 or less, and an open ratio of a wall surface of cells is 3% or more and 50% or less.

12 Claims, 5 Drawing Sheets

CLEANING ROLLER FOR CLEANING CHARGING ROLLER AND IMAGE FORMING APPARATUS

RELATED APPLICATION

This application is based on the Japanese patent applications Nos. 2007-340269 and 2008-291126, the contents of which are hereby incorporated by reference.

BACKGROUND OF THE INVENTION

The present invention relates to an electrophotographic image forming apparatus, and a cleaning roller for cleaning a charging roller used in this image forming apparatus.

An electrophotographic image forming apparatus has an electrostatic latent image bearing member which carries an electrostatic latent image. In operation for forming an image by the apparatus, an outer peripheral surface of the electrostatic latent image bearing member is uniformly charged to a certain potential by a charging device, and thereafter an electrostatic latent image is formed on the electrostatic latent image bearing member by exposure using an exposure device. The electrostatic latent image formed on the electrostatic latent image bearing member is developed by toner supplied from a developing device, thereby forming a toner image on the electrostatic latent image bearing member. The toner image formed on the electrostatic latent image bearing member is transferred to a recording sheet such as a paper sheet, directly or through an intermediate transfer member. The recording sheet with the toner image transferred thereto is heated or pressurized by a fusing device so that the toner image is fixed on the recording sheet.

Conventionally, a roller type charger has been used for the charging device. The charging roller is disposed in contact with the outer peripheral surface of the electrostatic latent image bearing member. By an application of a charging voltage to the charging roller, the outer peripheral surface of the electrostatic latent image bearing member is charged to a certain potential. Typically, the charging roller has a metal core and a conductive elastic layer covering an outer periphery of the metal core. A solid rubber such as a resin foaming member is used for the conductive elastic layer, and conductivity is provided to the charging roller by the addition of carbon black or metallic powder.

In this apparatus, foreign matters such as external additives of toner or the toner particles on the electrostatic latent image bearing member can be transferred and attached to the outer peripheral surface of the charging roller. The foreign matters attached to the charge roller can cause a charge defect, which results in a deterioration of the resultant images.

In order to solve the aforementioned problem, there is proposed a technique in which the cleaning roller for removing the foreign matters attached to the outer peripheral surface of the charging roller is disposed in contact with the outer peripheral surface of the charging roller.

Japanese Patent Publications JP 2006-330613 A, JP 2004-361916 A, JP 2005-227411 A disclose a technique of using a cleaning roller for cleaning the charging roller.

The cleaning roller disclosed in JP 2006-330613 A is characterized in that the surface of the cleaning roller for cleaning the charging roller is made of a polyurethane foam layer in which the number of cells of the polyurethane foam is increased. According to the cleaning roller, the cell wall surfaces of the polyurethane foam layer are brought into contacts with the charging roller to improve a scraping performance of the roller.

The cleaning roller disclosed in JP 2004-361916 A and JP 2005-227411 A is characterized in that the surface of the cleaning roller for cleaning the charging roller is made of a melamine-based resin layer with open-cell structure in which a density of the melamine-based resin layer is lessened. The melamine-based resin layer has an excellent flexibility so that foreign matters are readily scraped into the melamine-based resin layer. This causes the foreign matters to be accumulated on the cell surfaces of the melamine-based resin layer. Therefore, the charging roller is hardly damaged by the cleaning roller or the foreign matters on the surface of the cleaning roller.

However, in the cleaning roller disclosed in JP 2006-330613 A, each cell of the polyurethane foam layer is extremely small, and therefore the cells of the surface are easily occupied by the foreign matters such as an external additive. Therefore, the wall surface of the cells of the polyurethane foam layer is hardly brought into contact with the outer peripheral surface of the charging roller, and the scraping performance of the foreign matters is not necessarily sufficiently improved. In addition, when the polyurethane foam layer has a closed cell structure, the external additives are easily clogged or fixed to the cell wall surface inside of the cell surface. Therefore, the outer peripheral surface of the charging roller is easily damaged by the clogged and fixed matters of the external additives.

In the cleaning rollers disclosed in JP 2004-361916 A and JP 2005-227411 A, each cell of the melamine-based resin layer is rather large, and therefore the frequency of bringing the cell wall surface of the melamine-based resin layer into contact with the outer peripheral surface of the charging roller is lessened, thus deteriorating the scraping performance of the foreign matters. Further, since the melamine-based resin layer has the open-cell structure, the foreign matters scraped from the cell wall surface are easily dropped out of the melamine-based resin layer through another cell. In addition, since the foreign matters easily enter into the melamine-based resin layer, the foreign matters accumulated inside of the melamine-based resin layer are clogged by long-term use, thus deteriorating the collecting performance of the foreign matters.

Therefore, it is desired to provide the cleaning roller for cleaning the charging roller capable of efficiently recovering the foreign matters such as the external additive of the toner attached to the outer peripheral surface of the charging roller while preventing damage on the outer peripheral surface of the charging roller, and capable of excellently maintaining its recovery performance for a long period, and also it is desired to provide the image forming apparatus including this cleaning roller for cleaning the charging roller.

SUMMARY OF THE INVENTION

In order to solve the above-described problems, the present invention provides a cleaning roller for cleaning a charging roller. The cleaning roller is disposed in contact with an outer peripheral surface of a charging roller to remove foreign matters attached to the outer peripheral surface of the charging roller. The cleaning roller has a metal core and a polyurethane foam layer covering an outer peripheral surface of this metal core. The polyurethane foam layer includes a number of cells. The number of cells per inch is 40 or more and 80 or less, and an open ratio of a wall surface of cells is 3% or more and 50% or less.

According to the present invention, a number of cells can be brought into contact with the foreign matters such as external additives of toner in a region between the charging roller and the cleaning roller. Also, the cells are hardly clogged with the foreign matters. Further, more foreign matters can be taken inside than the closed-cell polyurethane foam, and clogging of the foreign matters hardly occurs. Accordingly, the foreign matters attached to the outer peripheral surface of the charging roller can be efficiently collected and its collecting ability is maintained for a long period.

DETAILED DESCRIPTION OF THE PREFERRED EMBODIMENTS

Preferred embodiments of the present invention will be described below with reference to the attached drawings. In the following description, the terms indicating specific directions such as "upper", "lower", "left", "right", and other terms including them such as "clockwise direction" and "counter-clockwise direction" are used for the better understanding of the invention with reference to the drawings, and the present invention should not be restricted by those terms.

1. Image Forming Apparatus

Figure 1:
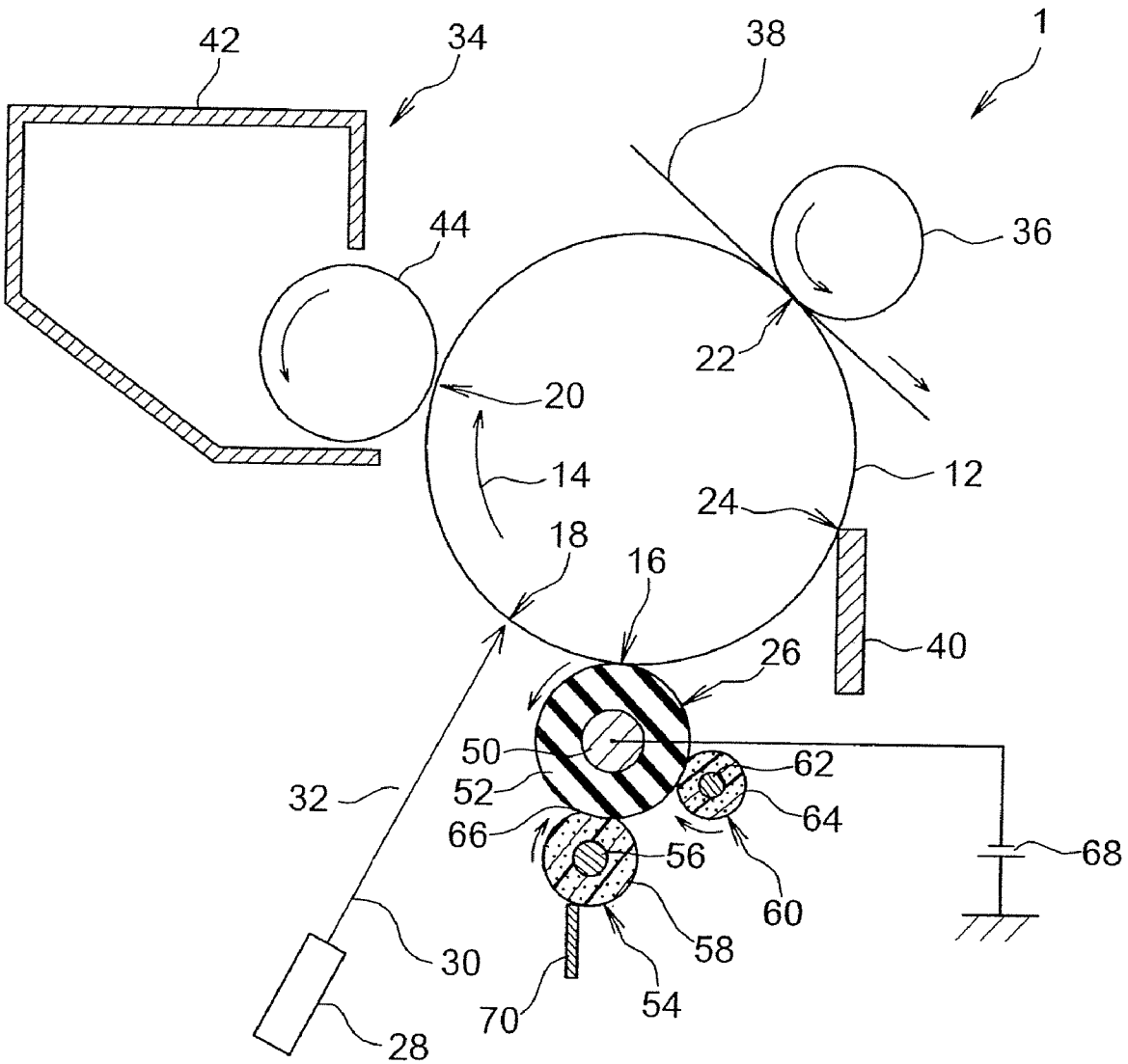
FIG. 1 is a diagram illustrating a schematic structure of an image forming apparatus according to the present invention.

FIG. 1 shows an electrophotographic image forming apparatus and its portions relating to image formations. The image forming apparatus may be any one of a copying machine, a printing machine, a facsimile machine, and a multifunction peripheral which includes functions of those machines in combination. The image forming apparatus 1 has an electrostatic latent image bearing member in the form of a photoreceptor 12. Although the photoreceptor 12 is made of a cylindrical member, the present invention is not limited thereto, and another photoreceptor in the form of an endless belt can also be used instead. The photoreceptor 12 is drivingly coupled to a drive motor not shown so as to be rotated in a direction shown by arrow 14 by the driving of the motor. Disposed around the photoreceptor 12 along its rotational direction are a charging station 16, an exposure station 18, a development station 20, a transfer station 22, and a cleaning station 24.

The charging station 16 includes a charging device in the form of charging roller 26 for charging an outer surface layer of the photoreceptor 12 with a certain potential. A structure of the charging roller 26 will be described later. The exposure station 18 has a path 32 through which image light 30 travels toward the outer peripheral surface of the charged photoreceptor 12. The image light 30 is emitted from an exposure device 28 disposed in the vicinity of or away from the photoreceptor 12, so that each of the incremental outer peripheral surface portions of the photoreceptor 12 passed by the exposure station 18 is formed with an electrostatic latent image. The electrostatic latent image includes portions where the image light is projected and the potential is reduced and portions where a charged potential is substantially maintained. In this embodiment, the portions where the potential is reduced correspond to image portions and the other portions where the charged potential is substantially maintained correspond to non-image portions. The development station 20 has a developing device 34 for visualizing the electrostatic latent image by using a powder developer. The developing device 34 has a developing roller 40 which is opposed to the outer peripheral surface of the photoreceptor 12 and a housing 42 for accommodating the developer.

In this embodiment, one component developer is used as the developer. Preferably, the toner made of small size particles is used in order to increase the quality of the resultant images. For example, the toner having an average particle size of 4.5 μm or more and 7.0 μm or less is used. The "average particle size" referred in this application indicates a volume average particle size measured by using the Flow Particle Image Analyzer (FPIA-2100) commercially available from Sysmex Corporation in Japan.

The volume average particle size is determined by the following method. Initially, a projection area is calculated for the particle. Then, a sphere having the same projection area as the calculated particle projection area is estimated. Further, a diameter and a volume of this sphere are determined as a particle size and a particle volume, respectively. After the particle size and the particle volume for a certain number of particles are obtained as above, a distribution of a volume reference is indicated with the particle size taken on the horizontal axis and integrated values of the volume taken on the vertical axis, in which the particle size corresponding to that an accumulated value of this volume reference distribution reaches 50% is determined as the volume average particle size.

The transfer station 22 has a transfer device 36 for transferring the visual image formed on the outer peripheral surface of the photoreceptor 12 onto a sheet 38 such as a paper and a film. In this embodiment, although the transfer device 36 is made of cylindrical roller, another transfer device such as a wire transfer device can also be used. The cleaning station 24 has a cleaning device 40 for collecting, from the outer peripheral surface of the photoreceptor 12, un-transferred toner particles remained on the outer peripheral surface of the photoreceptor 12, without being transferred to the sheet 38 in the transfer station 22. In this embodiment, although the cleaning device 40 is made of blade in the form of plate, another cleaning device such as rotary or stationary brush cleaning device can also be used instead.

In operation, the photoreceptor 12 is rotated in a clockwise direction according to the driving of the motor not shown. This allows that incremental outer peripheral portions of the photoreceptor passing through the charging station 16 are charged to a certain potential by the charging roller 26. The image light 30 is illuminated at the exposure station 18 so that the electrostatic latent image is formed on the charged outer peripheral portions of the photoreceptor. The electrostatic latent image is carried to the development station 20 with the rotation of the photoreceptor 12, where it is visualized by the developing device 34 into a developer image. The visualized developer image is carried to the transfer station 22 with the rotation of the photoreceptor 12, where it is transferred to the sheet 38 by the transfer device 36. The sheet 38 to which the developer image would be transferred is carried to a fusing station not shown, where the developer image is fused to the sheet 38. The outer peripheral portion of the photoreceptor passed the transfer station 22 is carried to the cleaning station 24, where the remaining developer on the outer peripheral surface of the photoreceptor 12 is collected.

2. Charging Roller

The charging roller 26 has a metal core 50 and a conductive elastic layer 52 covering an outer periphery of the metal core 50. The conductive elastic layer 52 is made of, for example, a solid rubber or a formed resin. An electric conductivity is provided by adding carbon black or electrically conductive particles such as metallic powders. The charging roller 26 is mounted for rotation and in parallel to the photoreceptor 12. The charging roller 26 is coupled to a drive motor not shown so as to rotate in a counterclockwise direction in the drawing. This allows that the photoreceptor 12 and the charging roller 26 are rotated in the same direction at a contact region between the photoreceptor 12 and the charging roller 26. A power source 68 for applying a charging voltage is connected to the charging roller 26 so that, when the charging voltage is applied to the charging roller 26 by turning on the power source 68, the outer peripheral surface of the photoreceptor 12 is charged to a predetermined potential.

The foreign matters such as external additives of the toner and improperly charged toner particles can attach to the outer peripheral surface of the charging roller 26, at the contact region between the photoreceptor 12 and the charging roller 26. In order to remove such foreign matters, a first cleaning roller 54 and a second cleaning roller 60 are disposed in contact with the outer peripheral surface of the charging roller 26.

3. Cleaning Roller for Cleaning the Charging Roller

Figure 2:
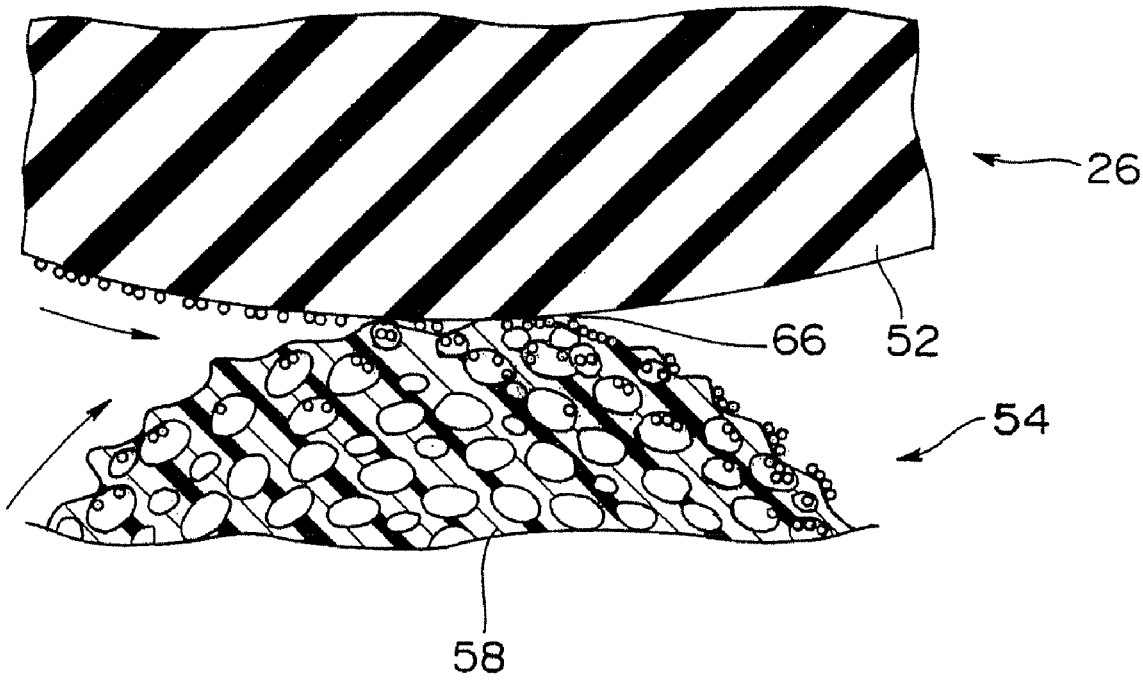
FIG. 2 is an enlarged cross sectional view which schematically illustrates contact portions of a charging roller and a cleaning roller.

The first cleaning roller 54 has a metal core 56 and a polyurethane foam layer 58 covering an outer periphery of the metal core 56. The structure of the polyurethane foam layer 58 will be described in detail later. The first cleaning roller 54 is disposed for rotation and in parallel to the charging roller 26. The first cleaning roller 54 is coupled to the drive motor not shown so that it rotates in a clockwise direction by the driving of the motor. This allows that the charging roller 26 and the cleaning roller 54 rotate in the same direction at the contact region 66 between the charging roller 26 and the cleaning roller 54. As shown in FIG. 2, the foreign matters on the charging roller 26 are scraped off by the cleaning roller 54 at the nipping region 66.

A peripheral speed of the cleaning roller 54 is determined in accordance with the peripheral speed of the charging roller 26. Specifically, the ratio $R(V_B/V_A)$ of a peripheral speed $V_B$ of the cleaning roller 54 to a peripheral speed $V_A$ of the charging roller 26 is determined, for example at 0.5 or more and 3 or less. If the peripheral speed ratio $R(V_B/V_A)$ is equal to or less than 0.5, a scarping force applied on the foreign matters by the cleaning roller 54 will not be obtained. Meanwhile, if the peripheral speed ratio $R(V_B/V_A)$ is equal to or greater than 3, an excessive force will be applied to the polyurethane foam layer 58 of the cleaning roller 54. It may also be possible that the cleaning roller 54 is rotated following the rotation of the charging roller 26, without drivingly coupling the cleaning roller 54 to the motor. In this instance, the peripheral speed ratio $R(V_B/V_A)$ is 1.0.

The cleaning roller 54 is disposed so that a contact force (or linear pressure) of 5N/m or more and 30N/m or less is applied to the charging roller 26. If the contact force to the charging roller 26 is smaller than 5N/m, the scraping force of the foreign matters on the charging roller 26 by the cleaning roller 54 is not obtained. Meanwhile, if the contact force applied to the charging roller 26 is larger than 30N/m, the excessive load is applied to the charging roller 26.

Preferably, the cleaning roller 54 is disposed so that a contact nip width in the peripheral direction between the cleaning roller 54 and the charging roller 26 is 3 mm or more and 8 mm or less. Specifically, the contact nip width of 3 mm or more ensures the scarping force for scraping the foreign matters from the charging roller 26 by the contact of the cleaning roller 54. Also, the contact nip width of 8 mm or less prevents an excessive loading on the charging roller 26.

An amount of compression of the polyurethane foam layer 58 at the contact with the charging roller 26 is preferably 5% or more and 40% or less of the thickness of the polyurethane foam layer 58. The compressed amount of 5% or more ensures a sufficient force for scraping the foreign matters on the charging roller 26 by the cleaning roller 54. Also, the compressed amount of 40% or less prevents an excessive loading on the polyurethane foam layer 58 of the cleaning roller 54.

A scraping member 70 is disposed in contact with an outer peripheral surface of the cleaning roller 54. A part of the foreign matters included inside of the polyurethane foam layer 58 of the cleaning roller 54 is scraped off by the scraping member 70 at the contact region between the cleaning roller 54 and the scraping member 70. Thus, excessive amount of foreign matters are not accumulated inside the polyurethane foam layer 58. This results in that the clogging of the foreign matters inside of the polyurethane foam layer 58 is prevented. According to the present invention, the scraping member may be eliminated. The structure of the scraping member will be described later.

The power source may be provided for applying a certain voltage to the cleaning roller 54 between the cleaning roller 54 and the charging roller 26 to form an electric field for electrostatically moving the foreign matters on the charging roller 26 to the cleaning roller 54.

Similar to the first cleaning roller 54, the second cleaning roller 60 has a metal core 62 and a polyurethane foam layer 64 covering an outer periphery of the metal core 62. The polyurethane foam layer 64 has the same structure as the that of the polyurethane foam layer 58 of the first cleaning roller 54. Also, similar to the first cleaning roller 54, the second cleaning roller 60 is disposed for rotation and in parallel to the charging roller 26. In this embodiment, the second cleaning roller is disposed on the downstream side of the first cleaning roller 54 in the rotational direction of the charging roller 26. The second cleaning roller may be disposed on the upstream side of the first cleaning roller 54. In addition, similar to the first cleaning roller 54, the scraping member for scraping the foreign matters inside of the polyurethane foam layer 64 may be disposed in contact with an outer peripheral surface of the second cleaning roller 60. Further, another cleaning member such as a stationary or rotary cleaning brush may be used instead of the second cleaning roller 60. According to the present invention, there is no need to provide a plurality of cleaning members for cleaning the charging roller and only the first cleaning roller 54 may be provided.

4. Polyurethane Foam Layer of the Cleaning Roller

Figure 3:
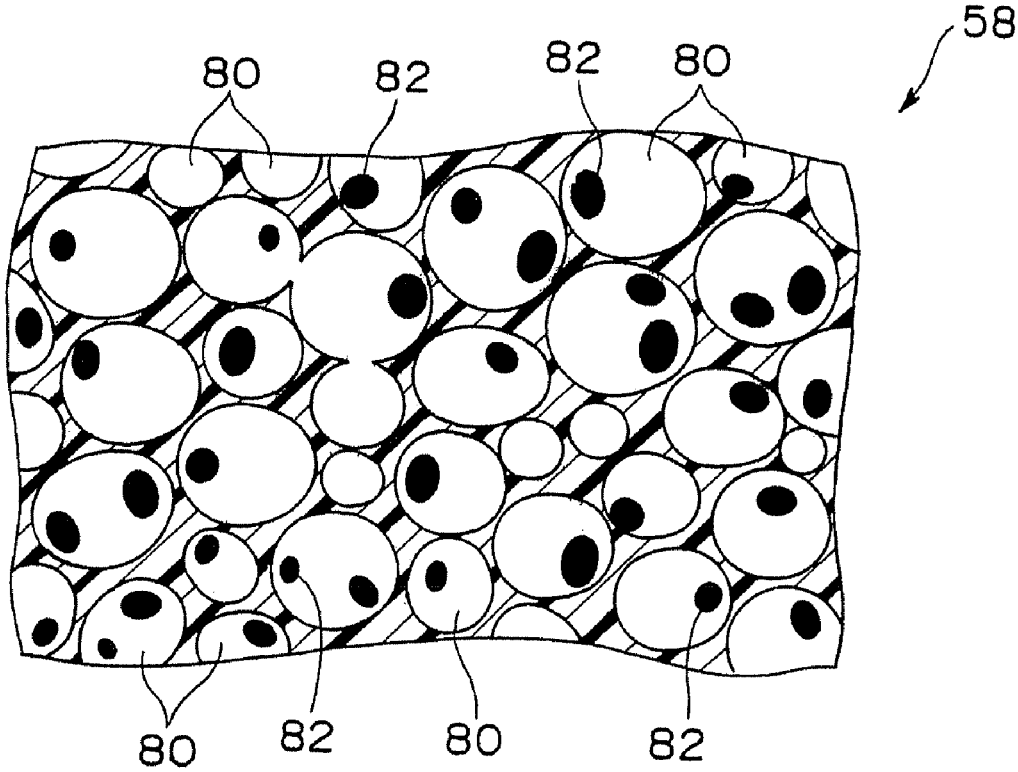
FIG. 3 is an enlarged cross sectional view which schematically illustrates cell structures of a polyurethane foam layer.

As shown in FIG. 3, the polyurethane foam layer 58 has a number of cells 80. Almost every cell 80 is connected with the neighborhood cell 80 via the opening 82 formed therebetween. An open ratio of the cell of the polyurethane foam layer 58, which is defined by $S_1/S\times100$ wherein $S_1$ is the area of the opening(s) 82 and S is the area of the entire wall surface of the cell 80, is set to be 3% or more and 50% or less. The open ratio is higher than the open ratio (about 1%) of the polyurethane foam having a closed-cell structure manufactured by a publicly-known mechanical froth method and is lower than the open ratio (about 60%) of the polyurethane foam having a open-cell structure manufactured by a publicly-known chemical foaming method. As above, the polyurethane foam layer 58 has the open-cell structure close to the closed-cell structure. Therefore, the polyurethane foam layer 58 takes more foreign matters than the polyurethane foam layer of closed-cell structure and also generates less clogging of the foreign matters within the cells, compared to the open-cell structure. Accordingly, the polyurethane foam layer 58 maintains an effective collecting performance for a long time.

The number of cells per inch of the polyurethane foam layer 58 is approximately 40 or more and 80 or less. The number of cells is smaller than the number of cells (about 100/inch) of the closed-cell polyurethane foam, and is larger than the number of cells (about 25/inch) of the open-cell polyurethane foam. Then, the polyurethane foam layer 58 allows more cells to make contacts with the foreign matters than the cells of the open-cell polyurethane foam in the nipping region 66 between the cleaning roller 54 and the charging roller 26. In addition, each cell of the polyurethane foam layer 58 is larger than that of the cell of the closed-cell polyurethane foam, and therefore each cell is hardly clogged with the foreign matters.

The polyurethane foam layer 58 has a low hardness which is substantially the same as the open-cell polyurethane foam layer. The hardness of the polyurethane layer 58 is defined by a load per unit area which is needed for compressing the foam layer until it has a reduction of 30% in thickness. In this embodiment, the polyurethane foam layer 58 has a hardness of 2 gf/mm or more and 6 gf/mm or less, which is smaller than the hardness (about 8.5 gf/mm) of the closed-cell polyurethane foam layer and is larger than the hardness (about 0.8 gf/mm) of the open-cell polyurethane foam layer. The hardness of 2 gf/m or more ensures an effective scraping of the foreign matters to prevent the foreign matters on the charging roller 26 from passing through the nipping region 66 between the charging roller 26 and the polyurethane foam layer 58 without being scraped off. The hardness of 8 gf/m or less ensures the polyurethane foam layer 58 not to provide an excessive pressing force to the outer peripheral surface of the charging roller 26. As a result, it is ensured that the foreign matters on the charging roller 26 are not crushed by the polyurethane foam layer 58 to cause an unwanted thin layer on the outer peripheral surface of the charging roller 26.

Preferably, an average diameter of the cells in the polyurethane foam layer 58 is 100 μm or more and 500 μm or less. The average diameter of the cells is smaller than the cell diameter (about 700 μm) of the open-cell polyurethane foam layer and is larger than the cell diameter (about 80 μm) of the closed-cell polyurethane foam layer. As such, the polyurethane foam layer 58 has smaller cells than those of the open-cell polyurethane foam layer, which allows the cells to make a frequent contact with the foreign matters and thereby the foreign matters to be effectively scraped off.

A density of the polyurethane foam layer 58 is lower than the density of the closed-cell polyurethane foam layer. In this embodiment, the density of the polyurethane foam layer 58 is 0.03 $g/cm^3$ or more and 0.2 $g/cm^3$ or less, which provides a flexibility of the polyurethane foam layer 58 and thereby prevents the charging roller 26 from being excessively pressed by the polyurethane foam layer 58.

Preferably, an electric conductivity is provided to the polyurethane foam layer 58 in order to form an electric field between the charging roller 26 and the cleaning roller 54. For this purpose, the polyurethane foam layer 58 has a volume resistance of $10^3$ Ωcm or more and $10^7$ Ωcm or less.

5. Manufacturing Method of the Polyurethane Foam

Discussions will be made to the manufacturing process of the polyurethane which is used for the polyurethane foam layer 58. The polyurethane foam may be produced through conventional mechanical froth method or chemical foaming method.

Both mechanical froth and chemical forming methods employ a certain technology in common in which polyol is mixed with isocyanate for foaming. The methods are different in that the mechanical froth method makes foams by the addition of gas such as inert gas, rather than using foaming agent, while the chemical foaming method makes foams by the chemical reaction of isocyanate with the foaming agent. The mechanical froth method produces the polyurethane foam with substantially homogeneous closed-cell structure, however, it is unable to produce a low-density, open-cell polyurethane foam. The chemical method, on the other hand, produces the low-density, open-cell polyurethane foam with ease, however, it is unable to produce a homogeneous, closed-cell polyurethane foam.

In contrast thereto, the method for manufacturing the polyurethane foam according to the invention, the foaming agent for the chemical foaming method is used in addition to polyol, isocyanate, and foaming gas used for the mechanical froth method. This results in that the polyurethane foam includes the physically generated foams made by the introduction of air and the chemically generated foams made by the chemical reaction between the isocyanate and the foaming agent. The physically and chemically generated foams are mixed and connected with each other to result in a homogeneous low-density polyurethane foam with open cells and closed cells.

The method for manufacturing the polyurethane foam according to the invention has several steps of preparing materials, mixing those materials, and heating the mixture.

In the first step for preparing the materials, materials for manufacturing the polyurethane foam are prepared. The materials include polyol, isocyanate, bubble forming gas such as inert gas, foaming agent, and auxiliaries such as catalyst.

One or more conventional polyols each having active hydrogen group may be used. For example, polyether polyol, polyester polyol, polycarbonate polyol or polydiene-based polyol may be used independently or in combination. Any of conventional aromatic, aliphatic, or alicyclic-based polyisocyanates, including toluene-diphenyl-diisocyanate (TDI), TDI prepolymer, methylene-diphenyl-diisocyanate (MDI), crude MDI, polymeric MDI, urethodione-modified MDI or carbodiimide-modified MDI may be used. Suitable gas such as nitrogen is used for the bubble forming gas. The foaming agent, such as water, which chemically reacts with polyisocyanate to generate gas, may be used. The foaming agent may be pre-mixed with polyol before the mixing step. For catalyst, an amine-based catalyst or an organic acid salt-based catalyst is used, for example. The amine-based catalyst results in an instant chemical foaming. The organic acid salt-based catalyst improves a rigidity of the frames of the polyurethane foam. Thermo-sensitive catalyst which performs an improved catalytic activity under the higher temperature is preferably used for the catalyst. With those materials, the hardening of the polyurethane foam is retarded than the chemical foaming by the amine-based catalyst, which ensures the chemical foaming of the polyurethane foam.

The hardness of the polyurethane foam varies with the type of the polyol and the isocyanate index, for example. The isocyanate index indicates the percentage of the ratio N/M wherein N represents the number of moles the isocyanate group in isocyanate and M represents the total number of moles of the hydroxyl group in the foaming agent and polyol. In order to obtain the desired hardness in the resultant polyurethane foam, it is preferable that the polyether polyol or the polyester polyol having a molecular weight of 1000 to 6000 and 2 to 5 functional groups is used and the isocyanate index is adjusted to be 90 to 110.

Using water as the foaming agent causes carbon dioxide through the chemical reaction of water with isocyanate, thereby forming the bubbles (cells). In order to form low-density polyurethane foam with fine cells, the carbon dioxide generated by the chemical reaction between the water and the isocyanate is preferably entrained within the physically generated bubbles (cells) generated by the forming gas. For this purpose, 0.3 to 1.5 parts by weight of water is preferably mixed with 100 parts by weight of polyol.

In the mixing step, the polyol mixed with the foaming agent such as water, isocyanate, bubble forming gas, and catalyst are mixed with each other. In this mixing, core foams are physically generated from the gas. Then, the chemical reaction occurs between the foaming agent included in the polyol and the isocyanate to generate gas such as the carbon dioxide. The chemically generated gas is entrained in the physically generated foams to increase the size of the foams (cells) and thereby to connect the neighboring foams with each other. As a result, homogeneous cells having large diameters are formed.

In the heating step, the mixture is heated up to a certain temperature. This accelerates the resin reaction to harden the frames of the polyurethane foam. A heating temperature and time in the heating step may vary depending upon materials of the polyurethane foam and is determined according to the mechanical froth method.

According to the above-described manufacturing method, the polyurethane foam having cells with higher open-ratio is obtained, compared to the polyurethane foam manufactured by the mechanical froth method. The manufactured polyurethane foam allows liquid to penetrate into its interior easily. Then, an electrical conductivity is provided to the polyurethane foam simply by immersing it into the liquid including conductive materials.

The polyurethane foam so manufactured is formed into a desired cylindrical configuration and then securely fixed on the metal core to obtain the cleaning roller 54.

A method of providing the conductivity to the polyurethane foam will be described. There are two possible methods for providing the conductivity to the polyurethane foam. The first method is to use the material in which the conductive material such as carbon black, polypyrrole, or ion conductive material is included. The second method is to impregnate the liquid with the conductive material into the polyurethane foam, which is more preferable than the first method. According to the second method, the characteristics of the polyurethane foam are not deteriorated even after the conductivity is provided thereto. In particular, the electric resistance and the hardness of the polyurethane foam are less susceptible to the environment.

The carbon black may be furnace black, thermal black, channel black, acetylene black, ketjen black, color black, and graphite. Another polymer material in which vinyl monomer is polymerized and branched on the carbon black or graphite may also be used.

The impregnation process will be described below. The carbon black is mixed with water or organic solvent together with binder to provide a liquid with a certain viscosity which is provided into the polyurethane. The binder is used for fixing the carbon black on the inner cell surfaces of the polyurethane foam. Preferably, a material having elasticity even after being fixed to the polyurethane foam, such as latex, is used for the binder. The viscosity of the liquid is not a critical factor. Preferably, however, the liquid has a viscosity of approximately 8 to 15 cps at a temperature of 25° C. in order to facilitate the impregnation the polyurethane foam with the liquid. The viscosity of the liquid may be controlled by changing a mixing ratio of the water or the organic solvent to the carbon black, or by adding a surface-active agent.

The impregnation may be made by applying the liquid on the surface of the polyurethane foam or by immersing the polyurethane foam into the liquid. Preferably, the liquid is provided into the surface portion of the polyurethane foam having a thickness of about 0.02 mm to 0.1 mm from its surface. The impregnation depth can be controlled by changing a discharge rate of the impregnation liquid from application device, the size of the cells, the concentration of the liquid, and the viscosity of the liquid.

With the controlling and applying methods of the impregnation liquid, a suitable conductivity is provided to the polyurethane foam layer 58 while preventing an excessive hardness increase of the polyurethane foam layer 58. Preferably, the volume resistivity of the polyurethane foam layer 58 is $10^3$ Ωcm or more and $10^7$ Ωcm or less. In order to reduce an affect on the hardness of the polyurethane foam layer 58, the volume resistivity of the polyurethane foam layer 58 is preferably $10^4$ Ωcm or more and $10^7$ Ωcm or less, more preferably $10^5$ Ωcm or more and $10^7$ Ωcm or less.

After the impregnation, the polyurethane foam is dried by heating. This results in that water or the organic solvent in the liquid in the polyurethane foam is vaporized, and the binder in the liquid is hardened, so that the conductive material in the liquid is fixed on the cell wall surfaces of the polyurethane foam to provide the conductivity for the polyurethane foam. The heating and drying of the polyurethane foam is performed, for example, for 20 minutes or more and 30 minutes or less under the temperature of 120° C. or more and 130° C. or less. However, a heating and drying condition is suitably determined, depending upon the material and the size of the polyurethane foam and the binder in the impregnation liquid.

The conductive polyurethane foam layer 58 exercises a mechanical and electrical cleaning of the charging roller 26 by the application of voltage between the charging roller 26 and the cleaning roller 54. For example, in order to remove the positively charged foreign matters, such as toner particles and external additives, remaining on the peripheral surface of the charge roller 26, a DC voltage ranging from 100 to 1000 volts is applied so that a negative current of, for example, −30 μA or more and −10 μA or less flows from the cleaning roller 54 toward the charging roller 26. This facilitates that the positively charged additives on the charging roller 26 are transferred to and collected by the cleaning roller 54 with an aid of the electric field formed therebetween. The electric field formed between the charging roller 26 and the cleaning roller 54 is not restrictive and any form of electric field such as alternative electric field may be applied therebetween. Also, the polarity of the foreign matter to be collected is not restrictive and the positively charged foreign matters can be collected by forming an opposite electric field between the rollers.

6. Scraping Member

Discussions will be made to the blade-type scraping member for scraping the foreign matters from the polyurethane foam layer 58 of the cleaning roller 54. The shape of the scraping member is not restrictive and it may take another form such as blade, bar, and roller.

In the embodiment shown in FIG. 1, the blade-type scraping member 70 is used. The material of the scraping member 70 is not restrictive and it may be made of urethane rubber or metal such as stainless or iron. Likewise, the bar-type scraping member may be made of rubber or metal.

Figure 4:
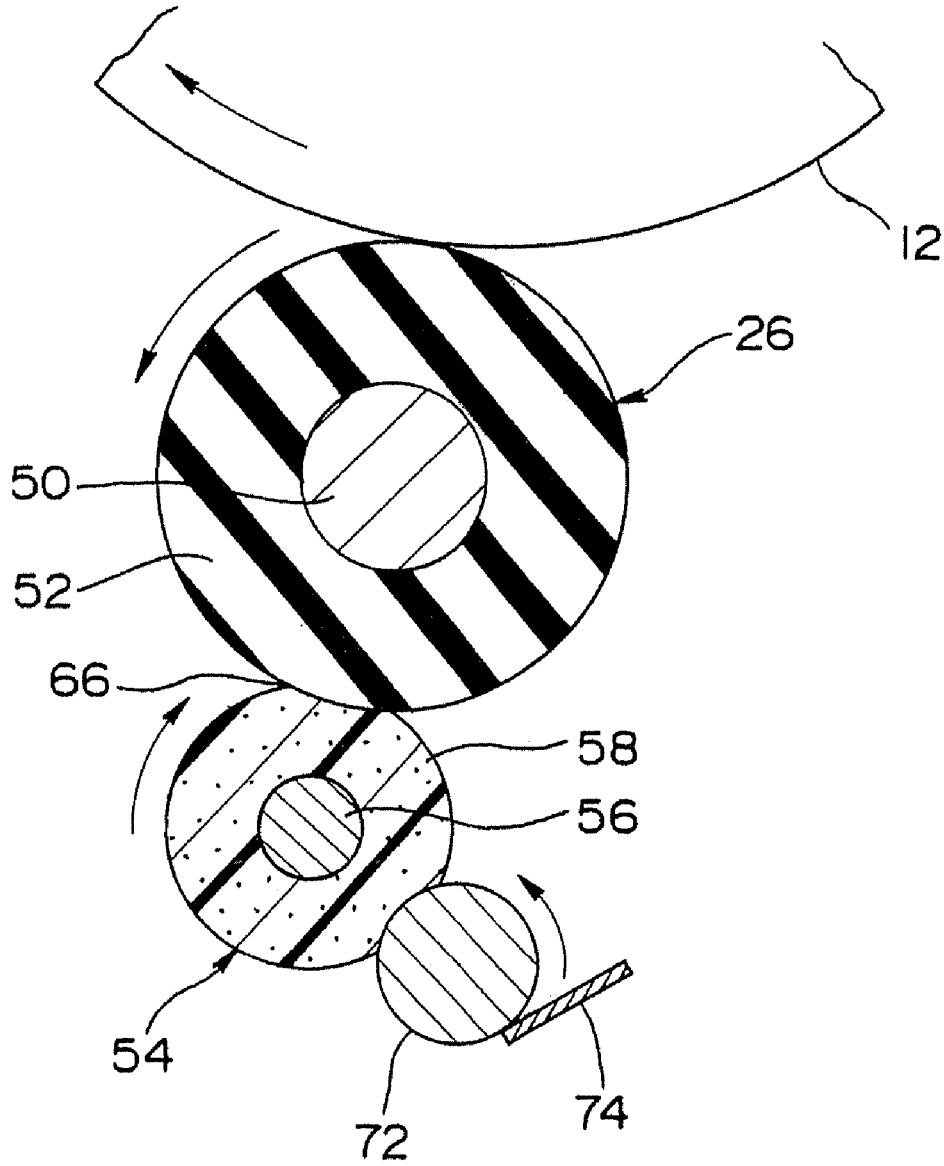
FIG. 4 is a cross sectional view which illustrates an embodiment using a roller-like scraping member.

In the embodiment shown in FIG. 4, the roller-type scraping member 72 is used. Preferably iron is used as the material of the scraping member 72. However, the material of the roller is not restrictive and other metals such as aluminum, stainless, metal alloy, rubber such as urethane, EPDM, or NBR may also be used. Other rollers such as coated roller having a coating layer provided on the periphery of the metal or rubber roller, a multilayer roller having a plurality of layers, and a brush roller having a brush layer on the periphery of the roller may also be used.

The scraping member 72 is disposed for rotation and in parallel to the cleaning roller 54 and drivingly coupled to the drive motor not shown so that it rotates in the counterclockwise direction by the driving of the motor. This allows that the peripheral portions of the cleaning roller 54 and the scraping member 72, passing through their contact region, move in the same direction.

A scraper 74 is provided adjacent the scraping roller 72 so that the tip end of the scraper 74 is in contact with the peripheral surface of the scraping roller 72. This allows that the foreign maters on the scraping member 72 are scraped off by the scraper 74, which ensures a good scraping performance of the scraping member 72 and, as a result, a good cleaning performance of the cleaning roller 54.

In the embodiment shown in FIG. 4, it is preferably not only to apply a voltage such as 200 volts between the charging roller 26 and the cleaning roller 54 but also to apply a certain voltage such as 100 volts between the cleaning roller 54 and the scraping member 72 to improve the scraping performance of the scraping member 72.

7. Pre-Charging Member

Figure 5:
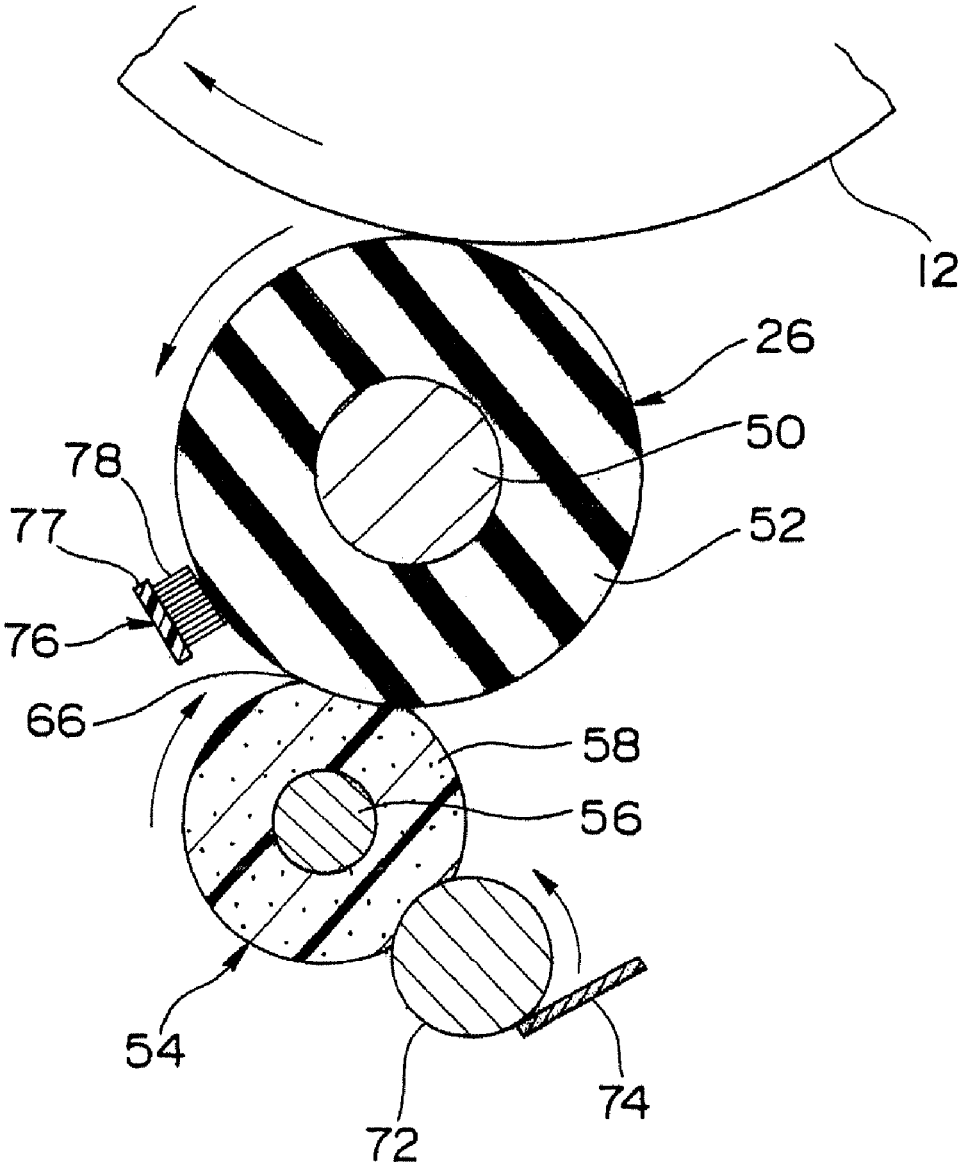
FIG. 5 is a cross sectional view which illustrates another embodiment using a pre-charging member.

As shown in FIG. 5, a pre-charging member 76 may be mounted on the upstream side of the cleaning roller 54 with respect to the rotational direction of the charge roller 26 to provide an even electric charge for the foreign matters remaining on the peripheral surface of the charge roller 26. In this embodiment, by applying a positive or negative voltage to the pre-charging member 76, the foreign matters on the charge roller 26 are charged into positive or negative polarity, which facilitates the foreign matters to be collected.

In the embodiment shown in FIG. 5, the pre-charging member 76 is made of a substrate 77 and brush fibers 78 planted thereto. The substrate 77 is made of electrically conductive member. The conductive member may be made by adding electrically conductive material into a suitable base material such as nylon resin, polyester resin, acrylic resin, or vinylon resin. The brush fibers 78 are planted in the substrate 77. Conductivity is provided to the brush fibers 78 by adding conductive material such as carbon black. Preferably, a diameter of the brush fibers 78 is 10 μm or more and 50 μm or less, more preferably 20 μm or more and 30 μm or less. Preferably, a density of the brush fibers 78 is 50 kF/inch$^2$ or more and 400 kF/inch$^2$ or less, more preferably 200 kF/inch$^2$ or more and 300 kF/inch$^2$ or less. Preferably, a free length of the brush on the substrate is 0.5 mm or more and 10 mm or less, more preferably 3 mm or more and 8 mm or less. Preferably, a volume resistivity of the brush fibers 78 is $10^5$ Ωcm or more and $10^{14}$ Ωcm or less, more preferably $10^6$ Ωcm or more and $10^8$ Ωcm or less.

If a voltage with negative polarity is applied to the charging roller 26, a major part of the toner particles attached to the charging roller 26 is positively charged because the negatively charged toner particles on the photoreceptor 12 are hardly attached to the charging roller 26. Actually, however, not only the positively charged foreign matters but also non-charged or substantially non-charged particles and the negatively charged foreign matters exist on the outer peripheral surface of the charging roller 26. Therefore, preferably, a positive voltage is applied to the pre-charging member 76 in order to provide an even positive charge for the foreign matters on the charge roller 26. The foreign matters so charged by the pre-charging member 76 are effectively collected by the negatively charged cleaning brush 54. In this instance, if the volume resistivity of the brush fibers 78 is $10^6$ Ωcm or more and $10^8$ Ωcm or less, the current of bias applied to the pre-charging member 76 is preferably 10 μA or more and 100 μA or less, more preferably 40 μA or more and 80 μA or less.

A negative voltage may be applied to the pre-charging member 76. In this instance, the pre-charging member 76 acts to evenly charge the foreign matters on the charging roller 26 to the negative polarity. This allows that the negatively charged foreign matters are efficiently collected by the positively charged cleaning roller 54. For this purpose, if the volume resistivity of the brush fibers 78 is $10^6$ Ωcm or more and $10^8$ Ωcm or less, the current to be applied to the pre-charging member 76 is preferably −100 μA or more and −10 μA or less, more preferably −80 μA or more and −40 μA or less.

In one embodiment, the pre-charging member 76 uses the brush fibers 78 with the fiber diameter of 20 μm, the density of 240 kF/inch$^2$, the pile length of 5 mm, and the volume resistivity of $10^8$ Ωcm. The brush fibers 78 are planted in close relation to each other on the substrate 77. The close planted fiber mass is rectangular in configuration extending along the longitudinal direction of the charging roller 26 and having a width of 10 mm in the transverse direction. For example, a DC voltage of 2,500 volts is applied between the pre-charging member 76 and the charging roller 26 so that a current of +60 μA flows from the pre-charging member 76 toward the charging roller 26. This allows that the foreign matters on the charging roller 26 are positively charged before being collected by the cleaning roller 54. Also, a DC voltage of 100 volts is applied between the scraping member 72 and the cleaning roller 54 and between the cleaning roller 54 and the charging roller 26 so that a current of −30 μA or more and −10 μA or less flows from the scraping member 72 through the cleaning roller 54 to the charging roller 26. This allows that the foreign matters positively charged by the pre-charged member 76 are well collected from the charging roller 26 by the cleaning roller 54 and the scraping member 72.

According to the embodiment having the pre-charging member 76, the biasing voltage to be applied to the pre-charging member 76 is controlled so that the foreign matters collected and retained within the pre-charging member 76 are discharged. For example, when the positive voltage is applied to the pre-charging member 76 at the cleaning of the charge roller 26, it is supposed that most of the foreign matters retained by the pre-charging member 76 have negative charge or no or substantially no charge. In this instance, by applying a negative voltage to the pre-charging member 76 at a suitable timing, the foreign matters are discharged from the pre-charging member 76 to the charge roller 26. After the completion of the discharge operation, a positive voltage is applied to the pre-charging member 76, which results in that the foreign matters discharged from the charge roller 26 are transported, by the rotation of the charge roller 26, again to the region opposing the pre-charging member 76 where they are positively charged by the pre-charging member 76 and then collected from the charge roller 26 by the negatively biased cleaning roller 54.

The structure of the pre-charging member is not limited the brush and it may be other forms provided that it has a charging ability. For example, the blade-type pre-charging member may also be used. In this instance, the pre-charging member is made of the same material as that of the brush fibers 78 and metals such as stainless and aluminum. A rotational pre-charging member may be used. In this instance, preferably, the outermost peripheral portion may be made of brush or foam material.

Although several embodiments of the invention have been described above, the scope of the invention is not limited thereto. For example, the manufacturing process of the polyurethane foam layer is not limited thereto and the layer may be formed in different processes.

EXAMPLES

A test was conducted to confirm suitable physical properties of the polyurethane foam layer of the cleaning roller for cleaning the charging roller. Specifically, the properties include the number of cells, open ratio of the cell wall surface, hardness, average cell diameter, and density.

In this test, provided were the image forming apparatus commercially available from KONICA MINOLTA under the trade-name of Magicolor5570 and several cleaning rollers for cleaning the charge roller. The second clearing roller 60 and the scraping member 70 were not installed in the apparatus.

Different polyurethane foam layers, made of materials 1-14 indicated in the following table, were provided to the charge roller. The materials 1-14 were manufactured by the method described in the above embodiments, by using polyol, isocyanate, amine-based catalyst, organic acid salt-based catalyst, water (foaming agent), and foam stabilizer. Specifically, used were polyether polyol (commercially available from MITSUI TAKEDA CHEMICALS, INC. under the trade-name of Actcall ED-37B (number average molecular weight of 3000)); methylenediphenyl diisocyanate (MDI) (commercially available from NIPPON POLYURETHANE IND. CO., LTD under the trade-name of Millionate MTL-S); amine-based catalyst commercially available from Kao Corporation under the trade-name of kaorizer No. 23NP; organic acid salt-based catalyst commercially available from PAN-TECHNOLOGY under the trade-name of EP73660A; and straight chain dimethyl polysiloxane commercially available from GESilicones under the trade-name of Niaxsilicone L5614 as the foam stabilizer. The amounts of the materials used are indicated in Table 1.

TABLE 1

| | | Kind of polyurethane foam | | | | | | |
|---|---|---|---|---|---|---|---|---|
| | | 1 | 2 | 3 | 4 | 5 | 6 | 7 |
| Raw materials | Polyol (pts.wt.) | 105 | 105 | 105 | 105 | 105 | 105 | 105 |
| | Isocyanate (pts. wt.) | 30.5 | 30.7 | 32.2 | 28.8 | 37.0 | 33.5 | 22.2 |
| | Amine-based catalyst (pts. wt.) | 0.31 | 0.31 | 0.35 | 0.29 | 0.45 | 0.39 | 0.17 |
| | Organic acid salt-based catalyst (pts. wt.) | 4.0 | 4.0 | 4.0 | 4.0 | 4.0 | 4.0 | 4.0 |
| | Water (pts. wt.) | 1.0 | 1.0 | 1.1 | 0.9 | 1.4 | 1.2 | 0.4 |
| | Foam stabilizer (pts. wt.) | 8.8 | 8.8 | 8.9 | 8.8 | 8.8 | 8.8 | 8.7 |
| Physical properties | Number of cells (number/inch) | 50 | 55 | 40 | 40 | 40 | 40 | 80 |
| | Average cell diameter (μm) | 300 | 250 | 400 | 400 | 500 | 500 | 100 |
| | Hardness of roller (gf/mn) | 3 | 3 | 2 | 6 | 2 | 6 | 2 |
| | Open ratio of cell wall surface (%) | 15 | 20 | 3 | 3 | 50 | 50 | 3 |
| | Density (g/cm$^3$) | 0.07 | 0.05 | 0.03 | 0.03 | 0.03 | 0.03 | 0.20 |

| | | Kind of polyurethane foam | | | | | | |
|---|---|---|---|---|---|---|---|---|
| | | 8 | 9 | 10 | 11 | 12 | 13 | 14 |
| Raw materials | Polyol (pts. wt.) | 105 | 105 | 105 | 105 | 105 | 105 | 105 |
| | Isocyanate (pts. wt.) | 18.8 | 26.2 | 22.8 | 34.2 | 23.0 | 28.5 | 32.5 |
| | Amine-based catalyst (pts. wt.) | 0.11 | 0.25 | 0.20 | 0.38 | 0.18 | 0.28 | 0.36 |
| | Organic acid salt-based catalyst (pts. wt.) | 4.0 | 4.0 | 4.0 | 4.0 | 4.0 | 4.0 | 4.0 |
| | Water (pts. wt.) | 0.2 | 0.7 | 0.5 | 1.2 | 0.5 | 0.9 | 1.1 |
| | Foam stabilizer (pts. wt.) | 8.7 | 8.7 | 8.7 | 8.8 | 8.7 | 8.8 | 8.8 |
| Physical properties | Number of cells (number/inch) | 80 | 80 | 80 | 35 | 85 | 50 | 50 |
| | Average cell diameter (μm) | 100 | 100 | 100 | 450 | 100 | 300 | 300 |
| | Hardness of roller (gf/mn) | 6 | 2 | 6 | 3 | 3 | 3 | 3 |
| | Open ratio of cell wall surface (%) | 3 | 50 | 50 | 15 | 15 | 2 | 55 |
| | Density (g/cm$^3$) | 0.20 | 0.20 | 0.20 | 0.03 | 0.20 | 0.07 | 0.07 |

The method for determining the physical properties of the materials 1-14 will be described. The cell number of the cleaning roller was determined by observing different surface portions of the roller (i.e, 24 (3×8) different lattice areas made of three regions in the longitudinal direction and eight regions in the peripheral direction) by the use of a scanning electron microscope (SEM), counting the number of cells per inch for each of the surface portions, and calculating the average number of the cells. The open ratio of the cell is determined by observing the peripheral surface of the cleaning roller by 100-fold magnification by the use of the scanning electron microscope (SEM), and calculating a ratio ($100S_1/S$ wherein $S_1$ is an open area and S is an observed area). The hardness was determined by forcing a circular aluminum plate of 55 mm diameter onto the polyurethane layer to reduce its thickness down to 70% of the original and measuring a repelling force (gf/mm) per length. The average cell diameter was determined by different surface portions of the roller (i.e, 24 (3×8) different lattice areas made of three regions in the longitudinal direction and eight regions in the peripheral direction) by the use of the scanning electron microscope (SEM), measuring diameters of ten cells for each surface portions (240 cells in total), and calculating the average of the measured diameters. The density was determined by obtaining the weight of the polyurethane layer simply by subtracting the weight of the metal core from the weight of the cleaning roller, obtaining the volume of the polyurethane layer, and dividing the weight by the volume.

In test, one experiment was made to each of 14 materials of the polyurethane foams. For each experiment, applied to the charging roller was a combined voltage of DC voltage (−600 volts) and AC voltage (peak-to-peak voltage of 2,000 volts, frequency of 150 Hz). The cleaning and charging rollers were set to rotate that the surface portions thereof move in the same direction at their contact region. Other conditions such as the contact pressure of the cleaning and charging rollers, the ratio R ($V_B/V_A$) of the peripheral speed $V_B$ of the cleaning roller with respect to the peripheral speed $V_A$ of the charging roller, the contact nip width in the rotational direction between the charging and cleaning rollers, the compressed amount of the cleaning roller against the charging roller, and the average particle size of the toner were determined as shown in Table 2.

The peripheral speed $V_A$ of the charging roller was 180 m/s, which is identical to that of the photoreceptor. The peripheral speed ratio R($V_B/V_A$) was changed by changing the peripheral speed of the cleaning roller.

Under the condition of a temperature of 23° C. and a humidity of 53%, 100,000 prints of solid image were continuously produced using the above image forming apparatus. After printing, the evaluations were made to the collection of the foreign matters from the charging roller and to the resultant images. The former evaluation was made to the collections of toner particles and external additives, independently and integrally.

The evaluation of the toner collection was made by attaching an adhesive tape commercially available from 3M under the trade-name of Scotch Mending Tape, and visually evaluating the amount of toner particles transferred on the tape. The results were ranked into three levels depending upon the area covered by the toner particles, "A": no toner particle, "B": partially covered, "C": entirely covered.

The evaluation of collecting external additives was made by visually observing the amount of additives attached on the periphery of the charging roller. Typically, the peripheral surface of the charging roller has black color and the additives have white color so that the additives on the charging roller can easily be recognized. The results were ranked into three levels depending upon the amount of additives on the charging roller, "A": no or substantially no additive observed", "B" : small amount of additives observed, and "C": large amount of additives observed.

The integrated evaluation was made by the use of the results for the collections of the toner particles and additives. Specifically, the combination of the former rank "A" and the latter rank "A" is ranked as "A", "A" and "B" as "B", "A" and "C" as "C", and others as "D".

The evaluation of the resultant images was made by when the image defects caused by an insufficient charging appeared. Specifically, the results were ranked into four levels; "A": no image defect appeared in 50,000th print, "B": the first image defect appeared between 10,000th-50,000th prints, "C": the first image defect appeared before 5,000th print. Practically, the resultant images of "A" and "B" had excellent and good qualities and meet the quality standards.

TABLE 2

| | Polyurethane foam layer | | | | | | | |
|---|---|---|---|---|---|---|---|---|
| | Material | The number of cells (number/inch) | Cell wall surface Open ratio (%) | Roller Hardness | Average cell diameter | Density | Contact pressure | Nip width |
| Example 1 | 1 | 50 | 15 | 3 | 300 | 0.07 | 15 | 5.0 |
| Example 2 | 2 | 55 | 20 | 3 | 250 | 0.05 | 12 | 5.0 |
| Example 3 | 3 | 40 | 3 | 2 | 500 | 0.03 | 5 | 3.0 |
| Example 4 | 4 | 40 | 3 | 6 | 500 | 0.03 | 30 | 8.0 |
| Example 5 | 5 | 40 | 50 | 2 | 500 | 0.03 | 5 | 3.0 |
| Example 6 | 6 | 40 | 50 | 6 | 500 | 0.03 | 30 | 8.0 |
| Example 7 | 7 | 80 | 3 | 2 | 100 | 0.20 | 5 | 3.0 |
| Example 8 | 8 | 80 | 3 | 6 | 100 | 0.20 | 30 | 8.0 |
| Example 9 | 9 | 80 | 50 | 2 | 100 | 0.20 | 5 | 3.0 |
| Example 10 | 10 | 80 | 50 | 6 | 100 | 0.20 | 30 | 8.0 |
| Example 11 | 11 | 35 | 15 | 3 | 450 | 0.03 | 15 | 5.0 |
| Example 12 | 12 | 85 | 15 | 3 | 100 | 0.20 | 15 | 5.0 |
| Example 13 | 13 | 50 | 2 | 3 | 300 | 0.07 | 15 | 5.0 |
| Example 14 | 14 | 50 | 55 | 3 | 300 | 0.07 | 15 | 5.0 |

TABLE 2-continued

| | Compressed amount | Toner Average particle size | Removal of toner | Removal of external additive | Removal of foreign matters (Comprehensive evaluation) | Image quality |
|---|---|---|---|---|---|---|
| Example 1 | 29 | 4.5 | A | A | A | A |
| Example 2 | 29 | 7.0 | A | A | A | A |
| Example 3 | 5 | 4.5 | A | A | A | B |
| Example 4 | 40 | 4.5 | A | A | A | B |
| Example 5 | 5 | 4.5 | A | A | A | B |
| Example 6 | 40 | 4.5 | A | A | A | B |
| Example 7 | 5 | 4.5 | A | A | A | B |
| Example 8 | 40 | 4.5 | A | A | A | B |
| Example 9 | 5 | 4.5 | A | A | A | B |
| Example 10 | 40 | 4.5 | A | A | A | B |
| Example 11 | 29 | 4.5 | B | C | D | C |
| Example 12 | 29 | 4.5 | C | B | D | C |
| Example 13 | 29 | 4.5 | C | B | D | C |
| Example 14 | 29 | 4.5 | B | C | D | C |

Discussions will be made to the test results in Table 2. The materials 1-10 meet the quality standards with respect to the collection of foreign matters. The materials 11-14, however, fails to meet the quality standards with respect to the collection of foreign matters and the resultant image. It is considered that the reason behind that is the cell number of the material 11 (35 per inch) is smaller than those of other materials (40-85 per inch), so that less number of cells of the polyurethane foam can be brought into contact with the charging roller and therefore the cleaning roller is not able to collect the foreign matters effectively from the charging roller. This indicates that the number of cells of the polyurethane foam layer is preferably 40 or more per inch.

Low marks were given to material 12. It is considered that the reason is that the cells are so small that they tend to be filled and clogged with foreign matters, which deteriorates the cleaning ability of the cleaning roller. This indicates that the number of cells of the polyurethane foam layer preferably ranges within 40-80 per inch.

Low marks were also given to material 13. It is considered that the reason is that the material 13 has a lower open ratio of 2% which is less than those of other materials (3-55%) and has substantially the closed-cell structure. For example, when using a closed-cell polyurethane foam layer, the foreign matters collected by the polyurethane foam layer are tend to be forced deeply into the interior of the layer where they clog and adhere on the cell walls. The clogging and adhering of the foreign matters provides physical may damage the outer surface of the charging roller by the contacts therewith. Therefore, the open ratio of the cell wall of the polyurethane foam layer is preferably 3% or more.

Low marks were also given to material 14. It is considered that the reason is that the open ratio of the material (55%) is larger than those of other materials (2-50%) so that the foreign matters are accumulated within the cells of the polyurethane foam layer, which deteriorates the cleaning ability of the cleaning roller. Therefore, the open ratio of the cell walls of the polyurethane foam layer is preferably than 3% or more and 50% or less.

Each of the materials 1-10, which meets respective quality standards, has a hardness of 2 to 6 gf/mm. This means that the hardness of 2 to 6 gf/mm provides a required cleaning ability provided that other conditions described above are also met.

Also, each of the materials 1-10 has an average cell diameter of 100-500 μm. This means that the average cell diameter of 100-500 μm provides a required cleaning ability provided that other conditions described above are also met.

Further, each of the materials 1-10 has a density of 0.03-0.2/cm$^3$. This means that the density of 0.03-0.2/cm$^3$ provides a required cleaning ability provided that other conditions described above are also met.

What is claimed is:

1. An image forming apparatus, comprising:

(a) a charging roller;

(b) a cleaning roller for cleaning the charging roller, the cleaning roller being disposed in contact with an outer peripheral surface of the charging roller to remove foreign matters attached to the outer peripheral surface of the charging roller, the cleaning roller having a metal core and a polyurethane foam layer covering an outer peripheral surface of this metal core, the polyurethane foam layer including a number of cells, the number of cells per inch being 40 or more and 80 or less, and an open ratio of a wall surface of cells being 3% or more and 50% or less;

(c) an electrostatic latent image bearing member for bearing an electrostatic latent image formed thereon;

(d) the charging roller being disposed in contact with an outer peripheral surface of the electrostatic latent image bearing member for charging the outer peripheral surface of the electrostatic latent image bearing member; and (e) a pre-charging member for uniformly charging foreign matters attached on the outer peripheral surface of the charging roller uniform, the pre-charging member being disposed on an upstream side of the cleaning roller with respect to a rotational direction of the charging roller.

2. The image forming apparatus according to claim 1, wherein a contact force of the cleaning roller to the charging roller is 5 N/m or more and 30 N/m or less.

3. The image forming apparatus according to claim 1, wherein a compressed amount of the polyurethane foam layer against the charging roller is 5% or more and 40% or less of a thickness of the foam layer, and a contact nip width between the cleaning roller and the charging roller is 3 mm or more and 8 mm or less in a peripheral direction of the cleaning roller.

4. The image forming apparatus according to claim 1, further comprising a scraping member for scraping off foreign matters included in the foam layer, the scraping member being disposed in contact with the outer peripheral surface of the cleaning roller.

5. The image forming apparatus according to claim 1, wherein a second cleaning member for cleaning the charging roller is disposed in contact with the outer peripheral surface of the charging roller.

6. The image forming apparatus according claim 1, wherein the charging roller and the cleaning roller for cleaning the charging roller are rotatable in respective directions so that portion of the charging roller and the cleaning roller in a contact region thereof move in the same direction.

7. The image forming apparatus according to claim 1, further comprising a toner for use in developing the electrostatic latent image, wherein an average particle size of the toner is 4.5 μm or more and 7.0 μm or less.

8. The image forming apparatus according to claim 1, wherein the polyurethane foam layer has a hardness which a load per unit area for compressing the foam layer until it has a reduction of 30% in thickness is 2 gf/mm or more and 6 gf/mm or less.

9. The image forming apparatus according to claim 1, wherein an average diameter of the cells is 100 μm or more and 500 μm or less.

10. The image forming apparatus according to claim 1, wherein a density of the foam layer is 0.03 $g/cm^3$ or more and 0.2 $g/cm^3$ or less.

11. The image forming apparatus according to claim 1, wherein a volume resistivity of the foam layer is $10^3$ Ωcm or more and $10^7$ Ωcm or less.

12. The image forming apparatus according to claim 1, wherein a polyurethane foam of the foam layer is manufactured by mixing polyol, isocyanate, and a foaming agent for generating foams by a chemical reaction between the isocyanate and a bubble forming gas.

* * * * *